United States Patent [19]

Lester et al.

[11] 4,253,588

[45] Mar. 3, 1981

[54] DISPENSING CLOSURE WITH DISC-LIKE MEMBRANE VALVE MEMBER

[75] Inventors: William M. Lester, 8 Brayton Rd., Livingston, N.J. 07039; Edward M. Brown, Livingston, N.J.; Edward J. Towns, Convent Station, N.J.

[73] Assignee: William Morris Lester, Livingston, N.J.

[21] Appl. No.: 34,289

[22] Filed: Apr. 30, 1979

[51] Int. Cl.[3] ..... B67D 3/00

[52] U.S. Cl. ..... 222/153; 215/270; 222/494; 222/495; 222/525

[58] Field of Search ..... 215/260, 270, 311; 222/153, 207, 213, 214, 215, 493, 494, 495, 514, 522, 524, 525, 498, 499

[56] References Cited

U.S. PATENT DOCUMENTS

| | | | |
|---|---|---|---|
| 2,877,918 | 3/1959 | Gardner | 215/311 X |
| 2,969,168 | 1/1961 | Newby | 222/525 |
| 2,980,302 | 4/1961 | Rasmussen | 222/525 X |
| 3,157,323 | 11/1964 | Kitterman | 215/311 X |
| 3,276,640 | 10/1966 | Kessler | 222/525 |
| 3,738,545 | 6/1973 | Roy | 222/525 |

*Primary Examiner*—David A. Scherbel
*Assistant Examiner*—Fred A. Silverberg

[57] ABSTRACT

A housing is threaded to the container and includes a valve stem having a flexible valve disc member. In the housing are upper and lower adjacent valve seats which mate with the disc member to form closed valves therewith. When in contact with the upper seat the valve can be opened and closed by the pressure differential between the container and the ambient. When manually placed in contact with the lower seat the disc member snaps in place by flexing over the upper seat into a locked closed valve state with the lower seat and does not open in response to pressure differentials between the container and the ambient.

18 Claims, 7 Drawing Figures

DISPENSING CLOSURE WITH DISC-LIKE MEMBRANE VALVE MEMBER

Figure 1:
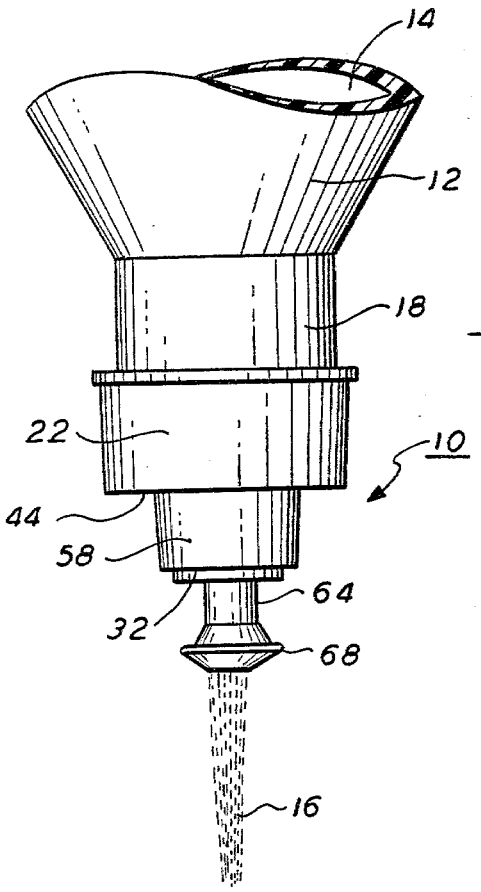

The present invention relates to dispensing closures for squeezable containers.

In copending application Ser. No. 941,142 filed Sept. 11, 1978, now U.S. Pat. No. 7,203,536 entitled Dispensing Closure for a Squeezable Container by William Morris Lester a closure is disclosed which operates in response to pressure differentials between the squeezable container and the ambient. A valve member is displaced to the open valve state by squeezing the container. Release of the container causes a negative pressure in the container as it returns to its unbiased condition. The negative pressure differential causes a force on the valve displacing it to the closed valve state.

It is undesired that accidental squeezing of the container while in transit open the valve and dispense the contents of the container. To prevent this, a locking position is provided which locks the valve in the closed/lock valve state.

In accordance with an embodiment of the present invention a fluid dispensing closure for a squeezable resilient container includes valve means including a flexible valve member responsive to a first pressure differential for placing the valve means in the open valve state with respect to a first valve seat and responsive to a second pressure differential opposite the first in direction for returning the valve means to the closed valve state with the first valve seat. A second valve seat is spaced from the first valve seat. Detent means are between the valve seats and engage the valve member when the valve member is displaced to the second seat. The valve member forms a closed valve with the second seat and is dimensioned to engage the detent means when seated on the second seat to prevent the opening of the valve member in the presence of the first pressure differential.

IN THE DRAWING

Figure 2:
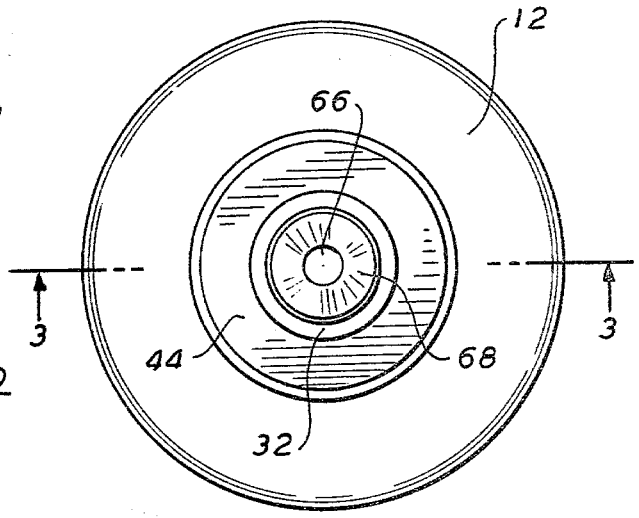
Figure 3:
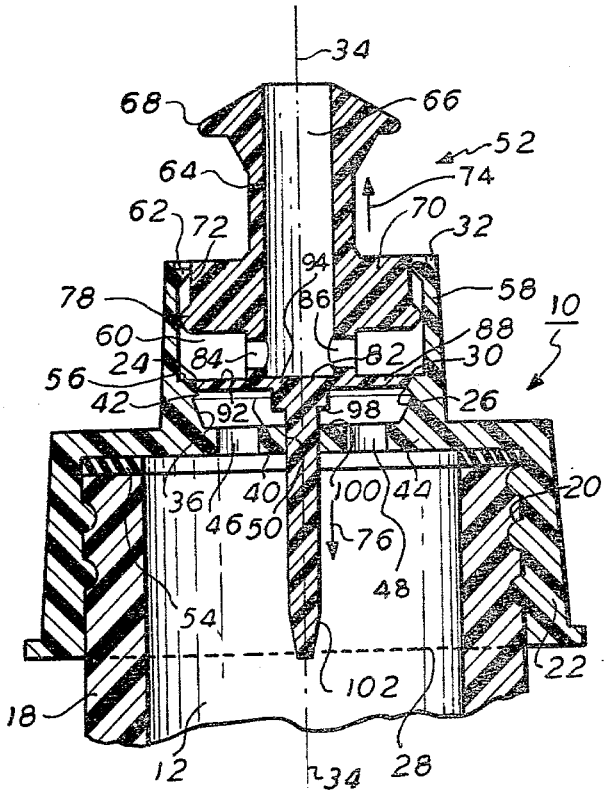
Figure 4:
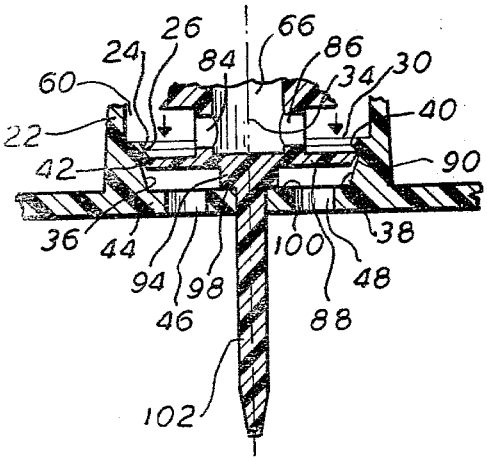
Figure 5:
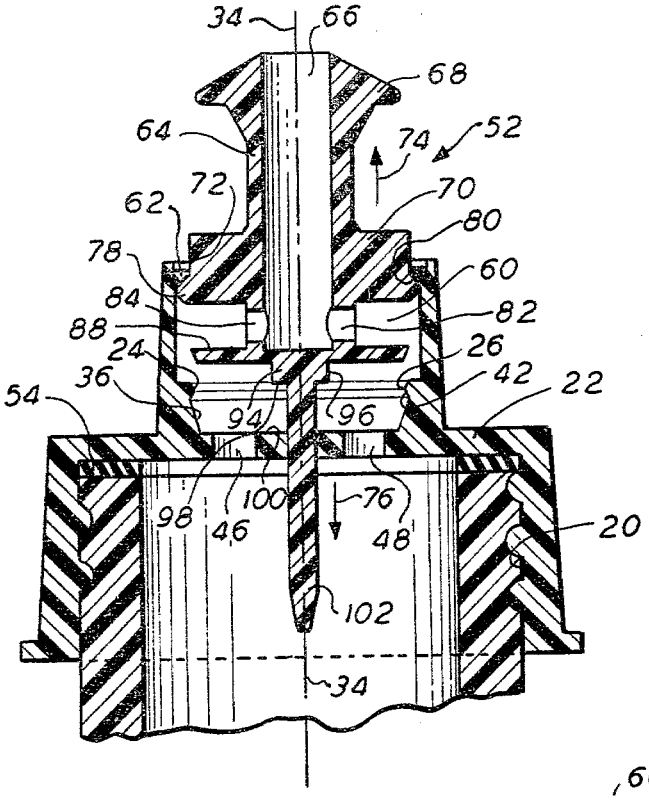
Figure 6:
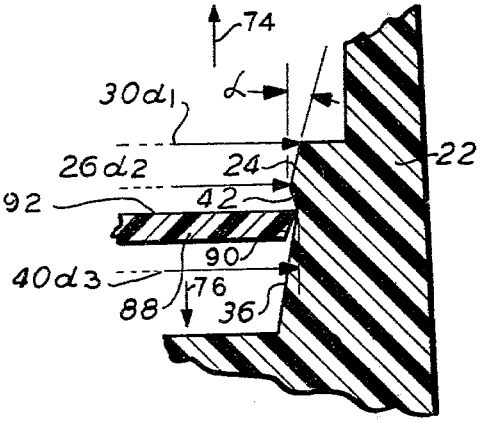
Figure 7:
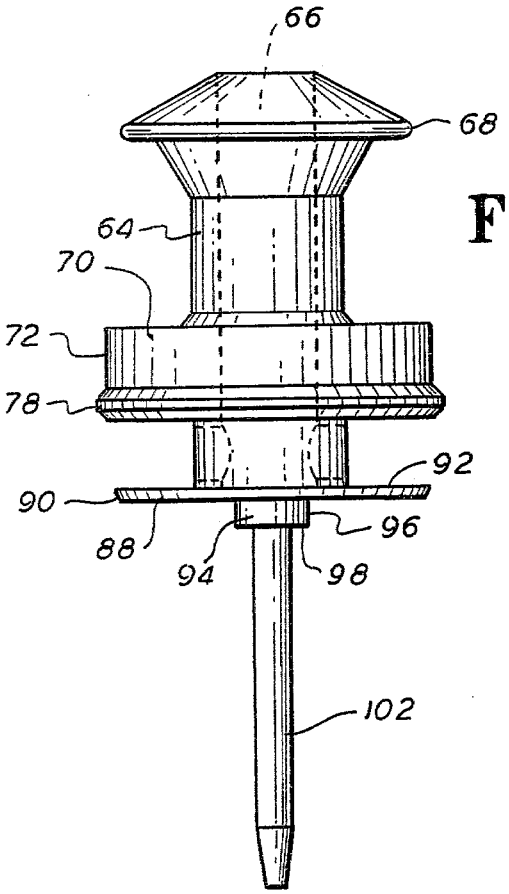

FIG. 1 is a fragmentary elevation view of a closure embodying the present invention mounted on a squeezable container for dispensing fluid from the container, FIG. 2 is a plan view of the closure of FIG. 1, FIG. 3 is a sectional view of the closure of FIG. 2 taken along lines 3—3 showing a closed valve in an unlocked state, FIG. 4 is a sectional view similar to the view of FIG. 3 with the valve in the locked closed valve position, FIG. 5 is a sectional view similar to the view of FIG. 3 with the valve in the open valve fluid dispensing position, FIG. 6 is an enlarged sectional view of the valve of the embodiment of FIG. 4, and FIG. 7 is a side elevation view of the valve member and stem assembly of the closure embodying the present invention.

In FIG. 1, the closure 10 embodying the present invention is illustrated as being useable with a plastic "squeeze" container 12 which may contain a variety of different fluids. For example, the fluids may include all kinds of liquids, viscous flowable materials such as pastes or fine granular materials such as powders. By depressing the container 12 at its sides the container is reduced in section. The sides being resilient have memory and tend to return to their original unsqueezed state when released. The squeezed condition increases the internal pressure at 14 above ambient and forces the contents against the closure 10 which is in full communication with the container interior. When the container is released a valve in the closure is forced closed by a reverse pressure differential caused by the container tending to return to its normal state. This action is described in more detail in the aforementioned copending application.

The closure has a dispensing mode and a lock mode. In the dispensing mode fluid at 14 is forced through the closure and is discharged in a stream 16. When in the locked mode, the contents of the container are retained in the container regardless of the squeezed condition of the container 12 during normal use. By normal use is meant manual squeezing and normal hazzards in transit. For example, the closure remains locked when subjected to an industry standard drop test in which a shipping container packed with filled squeezable containers is dropped to test for in transit hazzards.

The container 12 has a threaded throat 18 to which the closure 10 is mounted via internal threads 20, FIG. 3, formed in housing 22. The housing 22 external to thread 20 may be serrated to aid the manual mounting and unmounting of the closure 10 to container 12. Other fastening devices may be used instead of threads as may be convenient for a particular implementation. Housing 22 may be formed of any suitable material such as, for example, thermoplastics, and in particular, polypropylene or polyethelene.

Internal to housing 22, FIG. 3, is a tapered valve seat 24. Seat 24 is frustro-conical with its smallest diameter 26 closest to the open end 28 of the threaded portion of housing 22 and its largest diameter 30 closes to end 32 of housing 22. Seat 24 tapers radially outwardly and upwardly from diameter 26 to diameter 30. The slope of seat 24 is at an angle $\alpha$ with axis 34 (FIG. 6), which may be about 10°. In FIG. 6 the diameter 30 is shown as the diametrical dimension $d_1$ and the diameter 26, the diametrical dimension $d_2$.

A second tapered valve seat 36, FIG. 3, is between seat 24 and 28 of housing 22. Valve seat 36 is frustro-conical, end slopes at about the same angle as seat 24. That is the smallest diameter 38 of seat 36, FIG. 4, is closest to end 28 and the largest diameter 40 is closest to end 32. In FIG. 6 diameter 40 is shown as diametrical dimension $d_3$. The slope of seat 36 may also be at $\alpha$, about 10° with axis 34. Thus the seats 24 and 36 if extended would be on nested cones spaced along axis 34.

Seats 24 and 36 are separated by a reversely sloped frustro-conical wall 42. That is, wall 42 has its largest diameter 40 closest to end 28 and its smallest diameter 26 closest to end 32. Wall 42 preferably slopes at a smaller angle than angle $\alpha$, for example, at about 7° with axis 34.

In FIG. 3, a transverse bottom wall 44 separates the chamber formed by threads 20 from the seats 24 and 26, and wall 42 and extends to the side walls formed by threads 20. Wall 44 has a plurality of equally spaced holes 46, 48 which may number four (two being shown). The number of holes employed depends on hole size and viscosity of fluid to be dispensed. The holes 46 and 48 provide fluid communication between the interior volume of threads 20 and wall 44 with the volume enclosed by seats 24 and 36 and wall 42. The total area of holes 46 and 48 and others (not shown) is sufficient to provide the desired flow rate and pressure of fluid from the container 12.

A central guide aperture 50 is centered in wall 44 on axis 34. Aperture 50 guides valve stem 52 and centers the valves on stem 52 with respect to valve seats 24 and 36 and wall 42. Stem 52 and its valve disc 88 will be described in more detail later.

Annular gasket 54 seals the lip of container 12 to the underside of wall 44 to provide a fluid tight connection therebetween. Other sealing means may be used instead. For example, an annular bead may be molded into the underside of wall 44. Thus any pressure differentials between the ambient and the container 12 interior at 14 will dissipate, if at all, through apertures 46, 48 and 50.

The diameter 30 of seat 24 forms an inner edge of annular shoulder 56 which joins cylindrical upstanding side wall 58 to form an interior chamber 60 in housing 22 open to the volumes formed by seats 24 and 36, wall 42 and wall 44. A radially inwardly extending bead 62 projects from the inner surface of upstanding wall 58. Bead 62 encircles chamber 60. Fluid flowing through apertures 46 and 48 flows through the open valve volumes (FIG. 5) formed by seats 24 and 36 and wall 42 and thence into the chamber 60.

Stem 52 comprises an elongated tube 64 containing conduit 66 which extends along axis 34. The position of conduit 66 is not significant. The upper end of tube 64 terminates in a knob 68 shaped to be grasped by a thumb and index finger. A disc member 70 extends radially outwardly from about the lower end of tube 64. Member 70 is larger in dimension along axis 34 than bead 62. Side wall 72 of member 70 rides along and is guided by the radial inside surface of bead 62 in directions 74 and 76 parallel to axis 34. The lower edge of wall 72 terminates in a radially outwardly extending bead 78. Bead 62 has a minimum diametrical dimension smaller than the maximum diametrical dimension of bead 78. Thus when stem 52 is pulled in direction 74 bead 78 seats against bead 62, FIG. 5, at interface 80. Interface 80 forms a fluid seal for fluid in chamber 60 preventing the fluid from escaping between the interface 80 to the ambient from chamber 60. This interface engagement also forms a locking device preventing stem 52 from becoming disengaged and separated from housing 22. Conduit 66 extends below the disc member 70 and terminates at end 82.

A pair of holes 84 and 86 extend transversely through the side walls of tube 64 below disc member 70 to provide fluid communication between conduit 66 and chamber 60.

Below holes 84 and 86 extending radially outwardly from tube 64 is valve disc 88. Disc 88 is a relatively thin plane member which has the properties similar to spring steel. That is, disc 88 is slightly flexible and has good memory so that when left unbiased it snaps into its unbiased free plane state. For example, disc 88 may be made of 0.025 inch thick polypropylene or polyethelene thermoplastic material and have an outer diameter of about one half inch. Valve disc 88 has a tapered outer valve surface 90, FIG. 7. Disc 88 surface 90 is frustroconical having its largest diametrical dimension 92 closest to knob 68. Dimension 92 is greater than smaller diameter 26 ($d_2$), FIG. 6, of seat 24 so that surface 90 forms a closed valve with seat 24 when it abuts seat 24.

Surface 90 preferably tapers at an angle greater than $\alpha$, for example 12°, so that the greater diameter 92 makes approximately line contact with seat 24 or seat 36 about its periphery. This line contact provides pressure over a small area of surface 90 and thus improves the sealing action as compared to surface contact. Diameter 92 is also greater than the largest diameter 30 and 40 of seats 24 and 36, respectively, to insure interference fit with these seats. Contact between surface 90 and seat 24 may be made at locations on surface 90 other than diameter 92 depending on the relative slope of surface 90. Surface 90 flexes out of the plane of disc 88 when disc 88 is displaced in direction 76 into engagement with seat 36 by the smaller diameter 26. When the disc diameter 92 displaces below diameter 26 in transverse alignment with diameter 40, the disc snaps in place returning to its approximately unbiased state and forms a seal with seat 36. Wall 42 extends radially inwardly above surface 90 of disc 88 and serves as a detent, locking the disc in the closed valve position against seat 36. Disc 88 may be distorted in this locked position from its free plane unbiased state depending upon the relative dimensions of diameters 40 and 92. The edge of disc 88 at the intersection of diameter 92 and surface 90 seats in the valley formed by the intersection of wall 42 with seat 36 providing a relatively tight locking action.

To insure that disc 88 is so positioned, cylindrical boss 94 extends below disc 88 and has an outer diameter 96 greater than the diameter of guide hole 50, FIG. 3. Lower surface 98 of boss 94 abuts on the upper surface 100 of wall 44 to position the disc 88 in the closed valve and locked positions, FIG. 4. If the disc 88 were deflected beyond its yield point, as by accidental dropping of the container on the closure, it may permanently distort depending on the material used and possibly reduce the effectiveness of the seal. Boss 94 prevents such distortion.

The wall 42 is provided with a gradual reverse slope between seats 24 and 36 to permit manual displacement of disc 88 to the unlocked state in direction 74. That is, disc 88 at surface 90 slides upwardly past wall 42 when unlocked. If a horizontal step were provided instead of a slope the disc 88 may not be readily unlocked manually.

Guide pin 102 depends downwardly from boss 94 along and centered about axis 34. Pin 102 centers the disc 88 with respect to valve seats 24 and 36 and wall 42 to insure proper seating. Pin 102 need not fit tightly in hole 50 to accomplish the guide action. Pin 102 is always in hole 50 in both the open and closed valve states. The pin 102 and hole 50 should have a clearance between their diameters sufficient to insure the valve disc 88 seats on seat 24 without hitting against wall 56 when the valve is closed. A clearance is also desired to insure stem 52 responds to the pressure differentials.

The inner diameter of wall 58 and the outer diameter of bead 78, FIG. 3, may have about 0.005 inches clearance on a one half inch diameter. A similar clearance is present between bead 62 and wall 72. These clearances reduce friction between these members so that the valve responds to relatively low pressure differentials between the container interior 14 and the ambient in chamber 60.

It is believed that when a negative pressure differential is present, that is, when the ambient pressure is greater than the container interior pressure, the air in conduit 66 exerts a force in direction 76 on end 82 of the conduit 66 and the upper surface 92 of disc 88 in chamber 60. This force closes the disc 88 onto seat 24 prior to the pressure differential dissipating.

In operation, the housing is mounted to a squeezable container 12 containing a liquid or other fluid. The container is sealed against gasket 54. By finger pressure the valve stem 52 is depressed in direction 76 until a snapping action is heard. This displaces valve disc 88 over valve seat 24, over diameter 26, over wall 42 into engagement with seat 36. This action flexes disc 88 an amount to reduce its effective outer diameter sufficiently to permit disc 88 to lock in place at the interface of wall 42 and seat 36. At this time boss 94 abuts wall 44 to halt further displacement of stem 52 and thus the disc 88 in direction 76. This insures optimum sealing of the valve by preventing increased undesired distortion of the valve which might result in leakage if it were to lock in place at a lower position.

In an actual test performed a container with the above locked closure in place was crushed by a person under foot pressure. The relatively large pressure was surprisingly insufficient to dislodge the disc 88 from its locked position. However, light finger tip pressure in the direction 74 readily unlocks the disc 88 snapping it past diameter 26.

By grasping the knob 68 and pulling it in direction 74 until a snapping noise is heard, indicating flexing of disc 88 past diameter 26, the valve is placed in the unlocked state. The valve is closed by lightly depressing knob 68 in direction 76 until it does not easily move further. This seats disc 88 in valve seat 24. However, this action is also accomplished automatically.

By squeezing the container 12 and creating an internal pressure greater than ambient with the container inverted, FIG. 1, the fluid in the container is under pressure and is forced through holes 46 and 48 into the volume between valve disc 88 and wall 44. The fluid under pressure displaces the disc off its valve seat 24 in direction 74 to the position of FIG. 5. At this time the fluid flows past the valve into chamber 60. The fluid forces the disc 88 in direction 74 until beads 78 and 62 engage. A relatively good fluid seal at interface 80, FIG. 5, prevents substantial seepage to the ambient therebetween. Insignificant amounts of fluid may seep between wall 72 and bead 62 during this action.

The fluid under pressure is then forced from chamber 60 into holes 84 and 86 in tube 64 and then into conduit 66. The fluid flows along conduit 66, in direction 74, to the ambient to form the stream 16, FIG. 1.

Upon release of the squeezing action on the container 12, the natural resiliency of the container tends to return it to its larger unflexed state. This creates a vacuum inside container 12. The vacuum causes a significant pressure differential to exist on stem 52 via disc 88 and end 82 of hole 66 as discussed above and which is then forced down in direction 76 by the greater ambient pressure. This forces disc 88 into the closed valve position in engagement with seat 24. The valve is thus automatically closed.

Manually depressing the stem 52 until the disc 88 snaps in the lock position prevents accidental discharge of the fluid from the container. Seepage of residual fluid from chamber 60 past member 70 is minor when the valve is closed.

What is claimed is:

1. In a fluid dispensing closure for a squeezable container the combination comprising:

a housing including container fluid inlet means, an annular resilient valve member having a given valve surface diametrical dimension, said valve member comprising a plane disc-like membrane having upper and lower substantially parallel plane surfaces terminating at said valve surface at the peripheral edge of said membrane, means for displacing said member towards and away from said inlet means in a given axial direction, a first tapered valve seat having its smaller diametrical dimension smaller than said valve surface dimension, a second tapered valve seat having a greater diametrical dimension greater than said first valve seat smaller dimension and a smaller diametrical dimension smaller than said valve member dimension, said second seat being between said inlet means and said first seat in said given axial direction and sloping in the same general direction as said first seat, said valve member and valve seats each being dimensioned so that said valve surface makes substantially line contact with said valve seats only at said peripheral edge when engaged therewith, and fluid discharge cavity means in fluid communication with said valve member and seats.

2. The closure of claim 1 wherein said housing includes an annular wall facing a fluid chamber in fluid communication with said valve member and seats, a first annular shoulder extending radially inwardly from said wall, a stem member secured to said valve member and mounted within said chamber and including a second annular shoulder extending radially outwardly toward said annular wall and adapted to engage said first shoulder in the open valve position for sealing said chamber from the ambient at said shoulders and for limiting the travel of said valve member away from said inlet means in said given direction.

3. The closure of claim 2 wherein said fluid discharge means includes conduit means in said stem member in fluid communication with the ambient and said fluid chamber.

4. The closure of claim 2 wherein said stem means includes limit means for limiting the displacement of said valve member in a direction towards said second seat.

5. The closure of claim 1 wherein said housing includes first and second chambers, an apertured wall between the chambers forming said inlet means, said seats being in one of said chambers.

6. The closure of claim 5 wherein said wall includes a valve guide hole, said valve member including guide means in said guide hole for aligning said member with said seats.

7. The closure of claim 5 wherein said valve member includes stem means upstanding from said member, an annular disc-like member extending radially outwardly from said stem means and spaced from said valve member forming a fluid chamber therebetween, said discharge means including conduit means in said stem means in fluid communication with said fluid chamber and with the ambient.

8. The closure of claim 1 wherein said valve surface is tapered, the angle of said valve surface with said given axial direction being greater than the angle of said seats with said given axial direction.

9. The closure of claim 1 further including an annular wall intermediate said first and second seats, said annular wall tapering radially outwardly from said first seat to said second seat.

10. The closure of claim 1 wherein said seats slope at about the same angle with respect to said given direction.

11. The closure of claim 1 wherein said valve member is a disc-like membrane whose outer peripheral edge forms said valve surface.

12. The closure of claim 1 wherein the valve member lies in a plane which is normal to said given axial direction.

13. In a fluid dispensing closure for a squeezable container the combination comprising:

a housing including container fluid inlet means, means for securing the housing to the container, a first tapered annular valve seat in said housing with its smaller diametrical dimension closest to said inlet means, a flexible, stiff valve member which returns to its unflexed state when unstressed having an annular valve surface, the surface having a diametrical dimension greater than the smaller diametrical dimension of said first seat and dimensioned to abut with said first valve seat in the closed valve state, said member and seat forming a valve opening when the member is displaced to a second open valve position, said valve member comprising a plane disc-like membrane having upper and lower substantially parallel plane surfaces terminating at said valve surface at the peripheral edge of said membrane, and a second tapered annular valve seat in said housing between said first seat and said fluid inlet means, said second seat having its greatest diametrical dimension closest to said first seat, said member being dimensioned to abut with said second seat in a closed valve position, and a sloping surface connecting the smaller and greater diametrical dimensions respectively of said first and second seats whereby said member flexes when displaced from said first to said second seats and locks said valve member to said second seat between said sloping surface and said second seat in a closed valve position, said valve member and valve seats each being dimensioned so that said valve surface makes substantially line contact with said valve seats only at said peripheral edge when engaged therewith.

14. A closure valve comprising:

a housing forming first and second chambers which are open to the ambient at opposite ends of the housing, a dividing wall separating said chambers including a fluid inlet aperture in fluid communication with the two chambers, projection means extending inwardly from an upstanding wall of the first chamber, first and second tapered valve seats in the housing, the seats being in different spaced relation with respect to said dividing wall, each seat tapering in the same general direction with its smallest diameter closest to the second chamber open end, a valve member having a valve surface which is dimensioned to engage each said seats in a separate, different closed valve state and has a maximum diameter greater than the smallest diameter of the seat closest to said first chamber open end, said valve member comprising a plane disc-like membrane having upper and lower substantially parallel plane surfaces terminating at said valve surface at the peripheral edge of said membrane, said valve member and valve seats each being dimensioned so that said valve surface makes substantially line contact with said valve seats only at said peripheral edge when engaged therewith, upper wall means for enclosing the open end of said first chamber connected to said valve member and slideable within said first chamber, said means for enclosing including means for engaging said projection means for limiting the open valve displacement of said valve member in a direction away from said seats, and stem means connecting said valve member and upper wall means including fluid conduit means in fluid communication with said first chamber and the ambient.

15. The closure of claim 14 wherein said first and second seats are connected by an intermediate side wall which tapers in a direction reverse the taper of said seats.

16. A fluid dispensing closure for a squeezable resilient container comprising:

a housing, means for securing the housing to the container, a first valve seat coupled to said housing, valve means including a flexible valve member responsive to a greater than atmospheric pressure in said container when secured to the housing for placing the valve means in the open valve state with respect to said first valve seat and responsive to a less than atmospheric pressure in said container for returning the valve means to the closed valve state with respect to said first valve seat, said valve member comprising a plane disc-like membrane having upper and lower substantially parallel plane surfaces terminating at said valve surface at the peripheral edge of said membrane.

a second valve seat spaced from the first valve seat, said valve member and valve seats each being dimensioned so that said valve surface makes substantially line contact with said valve seats only at said peripheral edge when engaged therewith, and detent means between the seats for engaging said valve member, said valve member forming a closed valve with said second seat when engaged therewith and being dimensioned to engage said detent means when engaged with said second seat to prevent the opening of said valve member by said greater than atmospheric pressure.

17. The closure of claim 16 wherein said seats and valve member each have tapered valve surfaces.

18. The closure of claim 16 further including displacement limit means coupled to said valve member for limiting the displacement of said member in a direction towards said second valve seat from said first valve seat to thereby prevent undesired distortion of said valve member.

* * * * *